US009226074B2

(12) United States Patent
Zhu et al.

(10) Patent No.: US 9,226,074 B2
(45) Date of Patent: Dec. 29, 2015

(54) SURROUND WITH VARIATIONS OF CONCAVITY

(71) Applicant: Bose Corporation, Framingham, MA (US)

(72) Inventors: Weidong Zhu, Newton, MA (US); Johan Isaksson, Eldsberga (SE); Benjamin Peterson, West Boylston, MA (US)

(73) Assignee: Bose Corporation, Framingham, MA (US)

( * ) Notice: Subject to any disclaimer, the term of this patent is extended or adjusted under 35 U.S.C. 154(b) by 45 days.

(21) Appl. No.: 14/085,938

(22) Filed: Nov. 21, 2013

(65) Prior Publication Data

US 2015/0136517 A1 May 21, 2015

(51) Int. Cl.
*H04R 7/00* (2006.01)
*H04R 7/20* (2006.01)

(52) U.S. Cl.
CPC ..... *H04R 7/20* (2013.01); *H04R 2499/13* (2013.01)

(58) Field of Classification Search
CPC ..... H04R 7/20; H04R 7/00
USPC ..... 181/273, 267
See application file for complete search history.

(56) References Cited

U.S. PATENT DOCUMENTS

| | | | | |
|---|---|---|---|---|
| 3,961,378 | A * | 6/1976 | White | 29/594 |
| 5,371,805 | A | 12/1994 | Saiki et al. | |
| 5,418,337 | A * | 5/1995 | Schreiber | 181/171 |
| 5,892,185 | A * | 4/1999 | Takahashi et al. | 181/171 |
| 6,044,925 | A * | 4/2000 | Sahyoun | 181/157 |
| 6,176,345 | B1 * | 1/2001 | Perkins et al. | 181/173 |
| 6,851,513 | B2 | 2/2005 | Stead et al. | |
| 6,889,796 | B2 | 5/2005 | Pocock et al. | |
| 7,174,990 | B2 | 2/2007 | Stead et al. | |
| 7,416,047 | B2 * | 8/2008 | Frasl et al. | 181/173 |
| 7,510,047 | B2 * | 3/2009 | Muto et al. | 181/173 |
| 7,866,439 | B2 * | 1/2011 | Windischberger et al. | 181/157 |
| 7,931,115 | B2 | 4/2011 | Silver | |
| 7,974,431 | B2 | 7/2011 | Saiki | |
| 8,111,868 | B2 * | 2/2012 | Kaiya | 381/403 |
| 8,397,861 | B1 | 3/2013 | Xu et al. | |
| 2005/0257999 | A1 * | 11/2005 | Tomiyama et al. | 181/168 |
| 2008/0118090 | A1 | 5/2008 | Sheehan | |
| 2010/0310110 | A1 * | 12/2010 | Chen | 381/396 |
| 2012/0160598 | A1 | 6/2012 | Silver | |

* cited by examiner

*Primary Examiner* — Forrest M Phillips

(57) ABSTRACT

An acoustic device includes a resilient surround having a proportionately unequal distribution of half roll and inverted half roll segments. Half roll segments may be sized and located to provide additional clearance for internal components. Regions of transitional concavity may be sized and located to provide increased stiffness in one or more dimensions. Transitions between inversions of concavity may be smooth and free of localized inflexions.

26 Claims, 11 Drawing Sheets

SURROUND WITH VARIATIONS OF CONCAVITY

BACKGROUND

This disclosure relates generally to an acoustic source, and more particularly to a suspension member associated with an acoustic source.

SUMMARY

In accordance with an aspect, an apparatus comprises: a diaphragm; a rigid member; and a resilient surround which couples the diaphragm to the rigid member such that the diaphragm is movable in a reciprocating manner relative to the rigid member, the surround including adjacent segments of a first type and a second type differentiated by inversion of concavity, a total extent of segments of the first type being unequal to a total extent of segments of the second type.

In some implementations the first type of segment is a half roll and the second type of segment is an inverted half roll.

In some implementations the rigid member is associated with an enclosure, and the half roll segment provides additional enclosure volume to accommodate an element within the enclosure.

In some implementations the inverted half roll segment is located where additional volume within the enclosure is not needed.

In some implementations the surround is circular and regions of transitional concavity provide increased stiffness in a primary axis of vibration.

In some implementations the surround is non-circular and is characterized by a greater length in a first dimension than in a second dimension, and regions of transitional concavity are separated by a greater distance in the first dimension than in the second dimension and provide increased stiffness in a primary axis of vibration.

In some implementations the surround is a racetrack surround characterized by semicircular ends separated by a length in the first dimension, parallel sides separated by a length in the second dimension, and the regions of transitional concavity are located where the parallel sides transition to the semicircular ends.

In some implementations the half roll segments are characterized by a first radius of curvature, the inverted half roll segments are characterized by a second radius of curvature, and the first radius of curvature is unequal to the second radius of curvature.

In some implementations the half roll segments are characterized by a first width between inner and outer edges, the inverted half roll segments are characterized by a second width between inner and outer edges, and the first width is unequal to the second width.

In some implementations the surround has a non-constant width.

In some implementations the width is increased proximate to regions of transitional concavity.

In some implementations transitions between segments of the first type and the second type have smooth curvature.

In some implementations transitions between segments of the first type and the second type are free of localized radial cross-sectional inflexions.

In some implementations transitions between segments of the first type and the second type are free of localized circumferential cross-sectional inflexions.

In some implementations there are regions of transitional concavity characterized by a different material thickness than segments of the first and second types.

In some implementations concavity of the surround is centered at a constant radius.

In some implementations the radius is a midpoint between inner and outer edges of the surround.

In some implementations a total extent of half roll segments is less than 50% of a total extent of the surround.

In some implementations a total extent of half roll segments is less than 30% of a total extent of the surround.

In some implementations a total extent of half roll segments is less than 20% of a total extent of the surround.

In some implementations a total extent of half roll segments is less than 10% of a total extent of the surround.

In accordance with another aspect an apparatus comprises: a resilient element which couples a first rigid element to a second rigid element such that the first rigid element is movable in a reciprocating manner relative to the second rigid element, the resilient element including adjacent segments of a first type and a second type differentiated by inversion of concavity, a total extent of segments of the first type being unequal to a total extent of segments of the second type.

In accordance with another aspect an apparatus comprises: a resilient element which couples a first rigid element to a second rigid element such that the first rigid element is movable in a reciprocating manner relative to the second rigid element, the resilient element including multiple half roll segments and multiple inverted half roll segments, a total extent of the inverted half roll segments being greater than a total extent of the half roll segments; and an enclosure connected to the second rigid element, the enclosure characterized by high back pressure at peak excursion of the first rigid element toward the enclosure in a primary axis of vibration.

In some implementations at least one of the half roll segments provides increased clearance relative to an object proximate to the resilient element within the enclosure.

In some implementations at least one of the half roll segments provides increased local axial stiffness which improves rocking behavior.

In some implementations a total extent of the half roll segments is selected to minimize variation of radiating surface area of the resilient element as a function of displacement in the primary axis of vibration.

DETAILED DESCRIPTION

Figure 1:
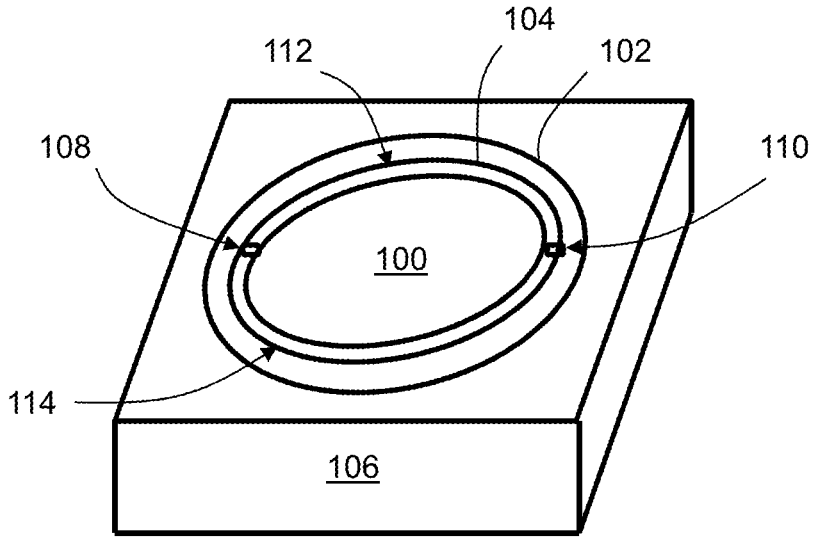
FIG. 1 is a perspective view of an acoustic device with asymmetric surround concavity variation.
Figure 2:
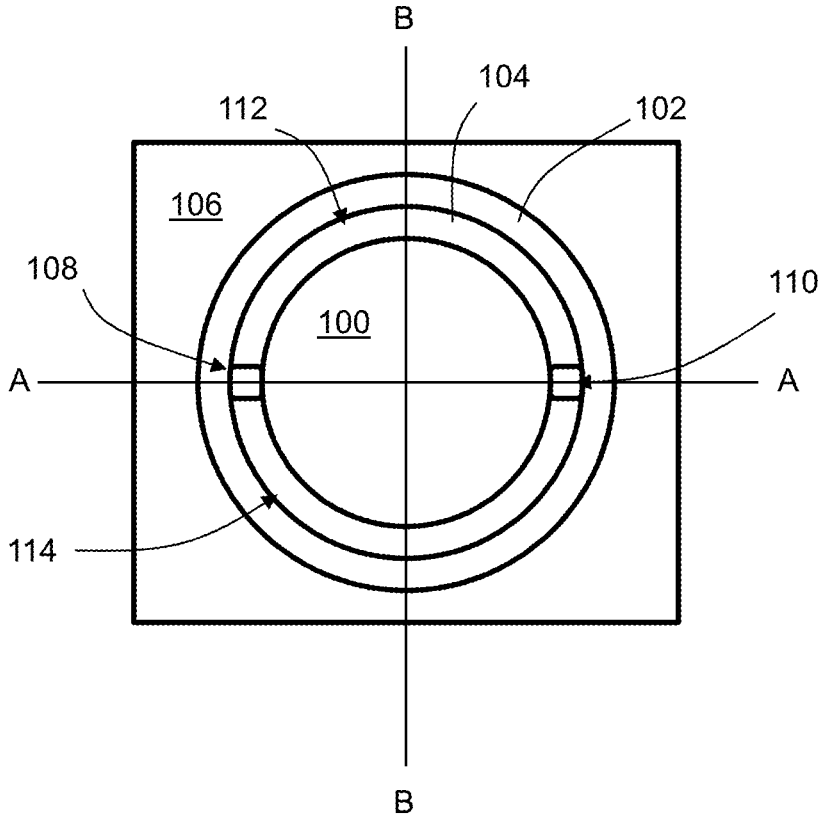
FIG. 2 is a top view of the device of FIG. 1.
Figure 3A:
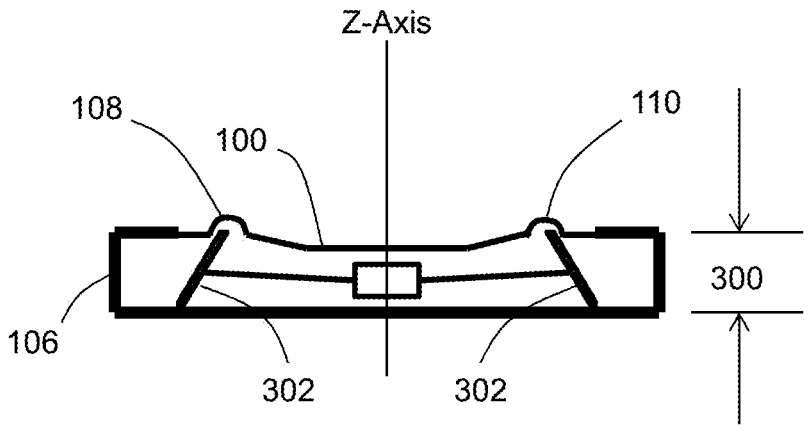
FIG. 3A is a cross-sectional view of the device of FIG. 2 along section A-A.
Figure 3B:
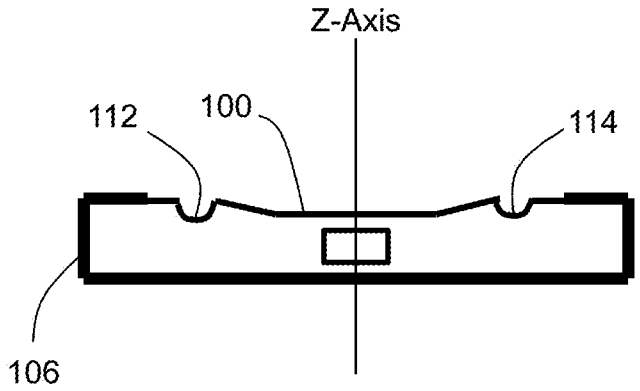
FIG. 3B is a cross-sectional view of the device of FIG. 2 along section B-B.

All examples, features and aspects can be combined in any technically possible way. For purposes of illustration some elements are omitted from the illustrated views and some dimensions are exaggerated.

FIGS. 1, 2, 3A and 3B illustrate an acoustic device such as a loudspeaker, driver or transducer. The acoustic device includes a circular diaphragm 100 (sometimes referred to as a cone, plate, cup or dome) coupled to a rigid frame 102 via a resilient suspension member which is hereinafter referred to as surround 104. The rigid frame is coupled to an enclosure 106. The surround 104 allows the diaphragm 100 to move in a reciprocating manner relative to the frame and enclosure in response to an excitation signal provided to a motor (not shown) that outputs a force to diaphragm 100. Movement of the diaphragm causes changes in air pressure which result in production of sound.

The illustrated surround 104 includes adjacent segments characterized by inversion of concavity and smooth inflections therebetween. In the illustrated example there are two half roll segments 108, 110 and two inverted half roll segments 112, 114. Each half roll segment may be characterized by a curved radial cross-section (e.g., elliptical segment, sometimes semi-circular) defined by a plane which contains the primary axis of excursion (Z-Axis) of the surround and diaphragm (See FIG. 3A). A convex surface of each half roll segment faces away from the interior of the enclosure, and a concave surface faces the interior of the enclosure. The inverted half roll segments may also be characterized by curved radial cross-sections (e.g., elliptical segment, sometimes semi-circular), but the concave surfaces face away from the interior of the enclosure and the convex surfaces face the interior of the enclosure (See FIG. 3B).

In the illustrated example the segments of differing concavity are in unequal proportions (not 50:50). In other words, the total extent of the half roll segments 108, 110 is not equivalent to the total extent of the inverted half roll segments 112, 114, where the extent of an individual segment can be measured, for example and without limitation, by arc length at a selected radius (e.g., inner perimeter or outer perimeter) in terms of distance, degrees or radians. The total extent of each type (inverted, non-inverted) of segment could be calculated as the sum of the extents of the individual segments of that type. In the illustrated example the inverted half roll segments 112, 114 have a greater total extent than the half roll segments 108, 110. In one example the total extent of half roll segments is less than 50% of the total extent of the surround. However, the total extent of inverted half roll segments could be less than or equal to 30%, 20% or 10% of the total extent of the surround.

The performance characteristics of a half roll are not identical to those of an inverted half roll. For example, the force-deflection curves of half rolls and inverted half rolls may differ due to curve asymmetry. One practical aspect of differences in performance characteristics is that an inverted half-roll may exhibit enhanced performance relative to a half-roll in association with enclosure designs which are characterized by relatively high back pressure loads (10% or more above atmospheric pressure). The inverted half roll generally produces lower total distortion due to the nonlinearities of both radiating surface area and back pressure. However, a half roll provides relatively more internal enclosure volume. Use of half roll segments together with inverted half roll segments in a surround can contribute to maintaining a relatively constant radiating surface area (Sd) as a function of diaphragm axial displacement. More particularly, Sd variation might be minimized when the total extent of half roll segments is equal to the total extent of inverted half roll segments. However, other characteristics can be realized when the total extent of half roll segments is less than the total extent of inverted half roll segments. For example, the total extent of half roll segments may be selected such that required motor force (the product of Sd and enclosure pressure (P)) in relation to displacement is almost linear. Moreover, as explained in greater detail below, different types of segments can be sized and located to take advantage of their different characteristics to achieve a variety of other results. The ratio of the total extent of half roll segments to the total extent of inverted half roll segments is thus a design parameter which may be selected based on various factors.

One aspect in which variations of surround concavity can be used is to provide additional clearance to accommodate elements located within the enclosure 106. For uses including but not limited to car audio it is sometimes desirable to have a low profile enclosure characterized by a reduced depth dimension 300. However, a low profile enclosure characterized by reduced depth can be problematic in terms of accommodating internal elements necessary for operation of the acoustic device. For example, reduction of the depth of the enclosure may be limited by potential interference between any of a wide variety of internal elements and the diaphragm 100 or surround 104. Such designs may also be characterized by high internal back pressure, e.g., 12% over atmospheric pressure in the illustrated example, and non-linearity in pressure as a function of excursion. Half roll segments can be sized and located to provide additional volume to accommodate components within the enclosure. Inverted half roll segments can be used wherever there is no need for a half roll segment. In the illustrated example the two half roll segments 108, 110 are used to provide additional internal enclosure volume to accommodate driver support arms 302, thereby providing enhanced packaging. The inverted half roll segments 112, 114 are used where additional internal enclosure volume is not required, thereby providing enhanced performance in the presence of high internal back pressure and enclosure pressure non-linearity.

The radius of curvature of half roll segment 108 may be the same as the radius of curvature of inverted half roll segment 112. However, referring to FIGS. 1 and 4, it should be noted that the half roll segments and inverted half roll segments of the surround do not necessarily have similar dimensions. For example, a radius of curvature 400 of half roll segment 108 may differ from a radius of curvature 402 of inverted half roll segment 112. Consequently, the radius of curvature of the inverted half roll segments is not necessarily a function of the internal volume considerations that might be used to determine the radius of curvature of the half roll segments. For example, the radius of curvature of the inverted half roll segments may be selected based on enclosure pressure non-linearity while the half roll radius of curvature may be selected to accommodate a particular element within the enclosure.

Figure 5:
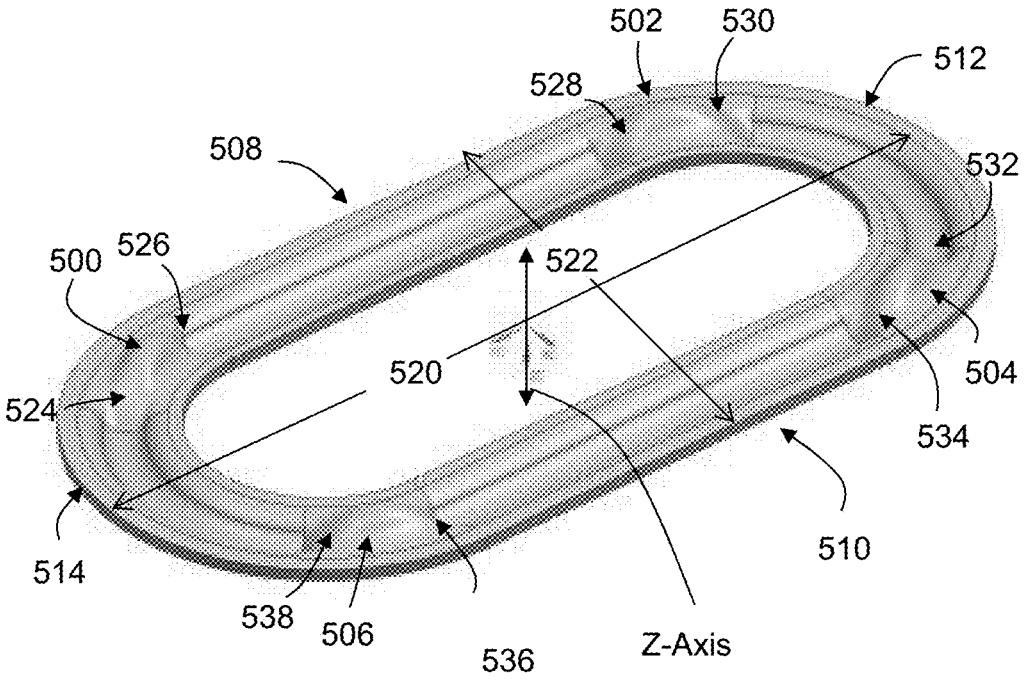
FIG. 5 illustrates a racetrack surround in accordance with some aspects.

Referring to FIG. 5, another aspect in which variations of surround concavity can be used is to achieve desired surround stiffness characteristics. Various factors including but not limited to inherent non-linearities of various elements, operation under large signal conditions where non-linearities are exercised, asymmetries in the dynamic response of structures to applied forces, and normal variations associated with manufacturing tolerances can result in an undesirable rocking behavior associated with excitation of resonant modes of vibration in other than the axial direction (the Z-axis in the illustrated example) when force is applied to the diaphragm. For example, when the diaphragm rocks at a fundamental rocking resonance frequency, it has a periodic rocking motion that is generally a rotation about an axis contained within a plane perpendicular to the primary vibration axis. Non-circular diaphragms may be more susceptible than circular diaphragms to rocking. A circular diaphragm has multiple rocking modes, but only one pure rocking mode which may be referred to as the primary rocking mode. A non-circular racetrack (parallel sides and semi-circular ends) or oval diaphragm does not have only one pure rocking mode. For example, the illustrated racetrack diaphragm has a first rocking mode related to a first length dimension 520 (rocking mode 1) and a second rocking mode related to a second length dimension 522 (rocking mode 2). The different length dimensions present different rocking force arms. More particularly, the second length dimension 520 has a greater rocking force arm than the first length dimension 522 because of the relatively greater distance from the point of applied force, e.g., the center of the diaphragm. Transitions between half roll and inverted half roll segments may exhibit greater axial stiffness in the Z-Axis than either the half roll or inverted half roll segments because the transition regions have less free length and exhibit higher stress at excursions. Consequently, transition of concavity can be sized and located so as to increase axial stiffness in the Z-axis at selected locations. In the illustrated example half roll segments 500, 502, 504, 506 characterized by a relatively small extent are separated from parallel inverted half roll segments 508, 510 and semi-circular inverted half roll segments 512, 514 by transition regions 524, 526, 528, 530, 532, 534, 536, 538. The half roll segments may have such a small extent that the inverted half roll segments are separated by regions of continuous or nearly continuous transition of concavity. In either case the transition regions are characterized by relatively greater axial stiffness than the inverted half roll segments 508, 510, 512, 514. The illustrated transition regions increase stiffness against rocking in the first length dimension 520 characterized by relatively greater differences of excursion at the semi-circular inverted half roll segments 512, 514 than at the sides 508, 510, thereby increasing rocking resistance. The rocking resistance arm increases as the distance between the transition regions in the first length dimension 520 is increased. Consequently, anti-rocking stiffness can be provided by increasing local axial stiffness with transition regions and selecting an appropriate distance between the transition regions and the point of applied force in the first length dimension. For example, the transition regions may be separated by a greater distance in the first dimension than in the second dimension. The illustrated racetrack surround is characterized by semicircular ends (including segments 502, 512, 504, 506, 514 and 500) separated by a length in the first dimension 520, parallel sides (including segments 508, 510) separated by a length in the second dimension 522, and transition regions 524, 526, 528, 530, 532, 534, 536, 538 which are located proximate to where the parallel sides transition to the semicircular ends.

Figure 6A:
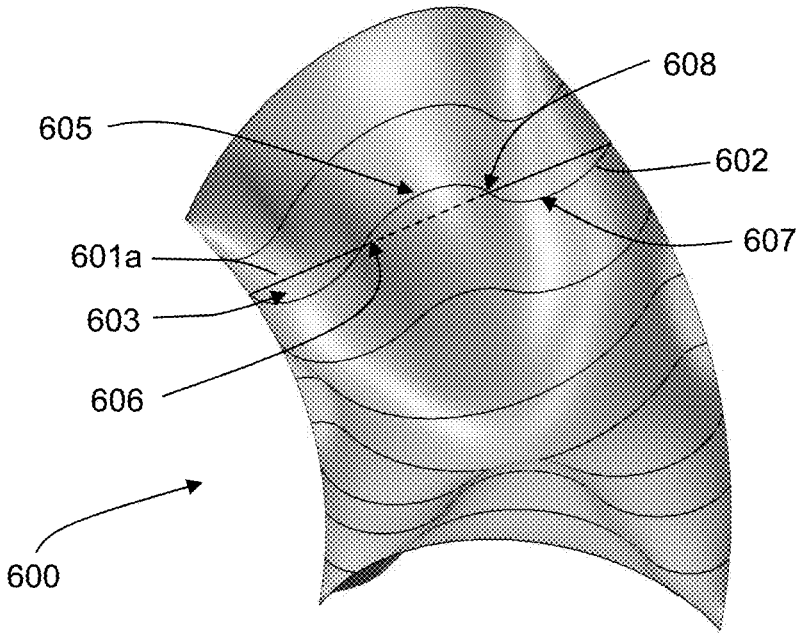
Figure 6A Prior Art
FIGS. 6A and 6B illustrate differences in cross-sectional curvature of the surround relative to the prior art.
Figure 6B:
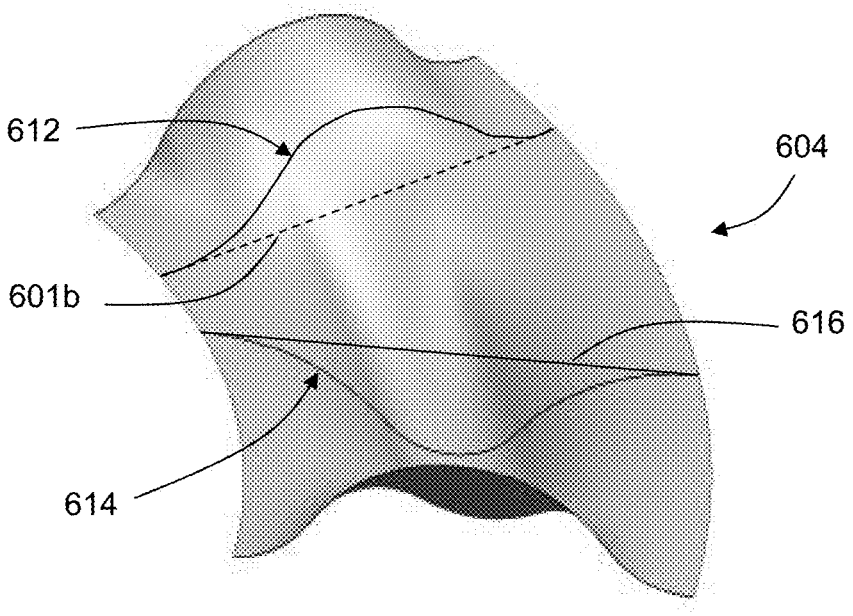

Transitional radial cross-sectional curvature may be enhanced in accordance with some aspects. Differences in radial cross-sectional curvature relative to the prior art at transitions of concavity can be seen with reference to FIGS. 6A and 6B. FIG. 6A is a representative model of a prior art surround 600 based on the surround disclosed in FIG. 13 of U.S. Pat. No. 5,371,805. As shown in FIG. 6A, localized radial cross-sectional inflexions 603, 605 and 607 defined relative to a radial reference line 601*a* from an inner edge to an outer edge of surround 600 are present because a cross-section 602 of the surround traverses the radial reference line 601*a* at positions 606 and 608. In other words, an area of primary concavity at inflexion 605 is radially adjacent to areas of opposite concavity at inflexions 603, 607. In contrast, as shown in FIG. 6B, relative to corresponding radial reference line 601*b* from an inner edge to an outer edge of surround 604, a cross-section 612 does not traverses the radial reference line 601*b* so no localized radial cross-sectional inflexions are defined. Similarly, a cross-section 614 does not traverse a radial reference line 616. In other words, only a primary concavity is presented in a radial cross-section. Localized radial cross-sectional inflexions are not necessarily eliminated entirely, but may be reduced in number and magnitude. It should also be noted that changes in concavity may be present between the inner and outer edges. Reduction or elimination of localized radial cross-sectional inflexions may reduce undesirable stresses both from surround manufacturing and from surround deformation at certain excursions. The surround 604 in FIG. 6B may also be characterized by radial cross-sections having smooth curvature. A function $f$ is of differentiability class $C^k$ if the derivatives $f', f'', \ldots, f^{(k)}$ exist and are continuous, where k is a non-negative integer. The function $f$ is said to be of class $C^\infty$, or smooth, if it has derivatives of all orders.

Figure 7A:
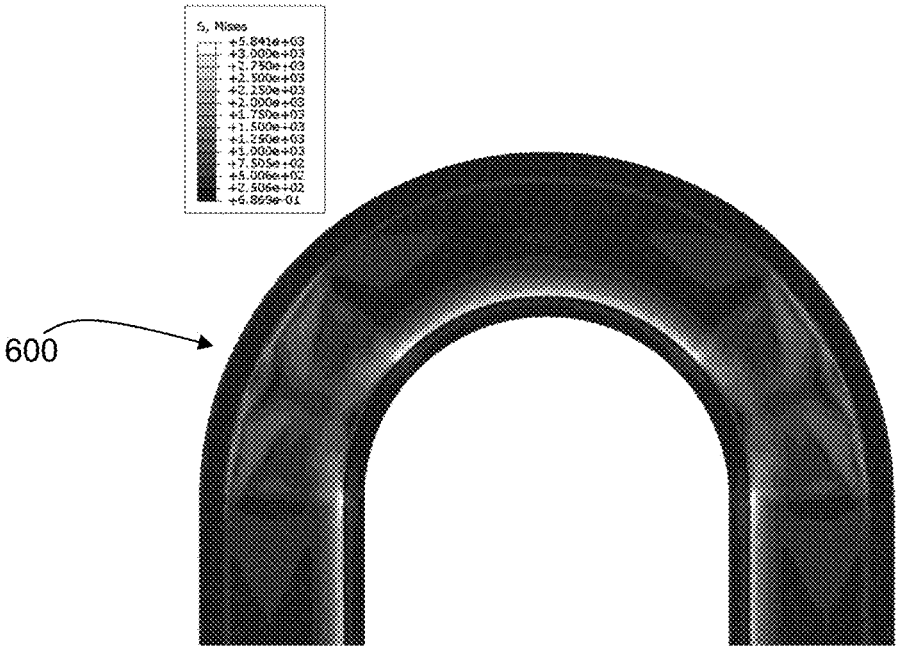
Figure 7A Prior Art
FIGS. 7A and 7B illustrate stress at peak displacement of the surrounds of FIGS. 6A and 6B.
Figure 7B:
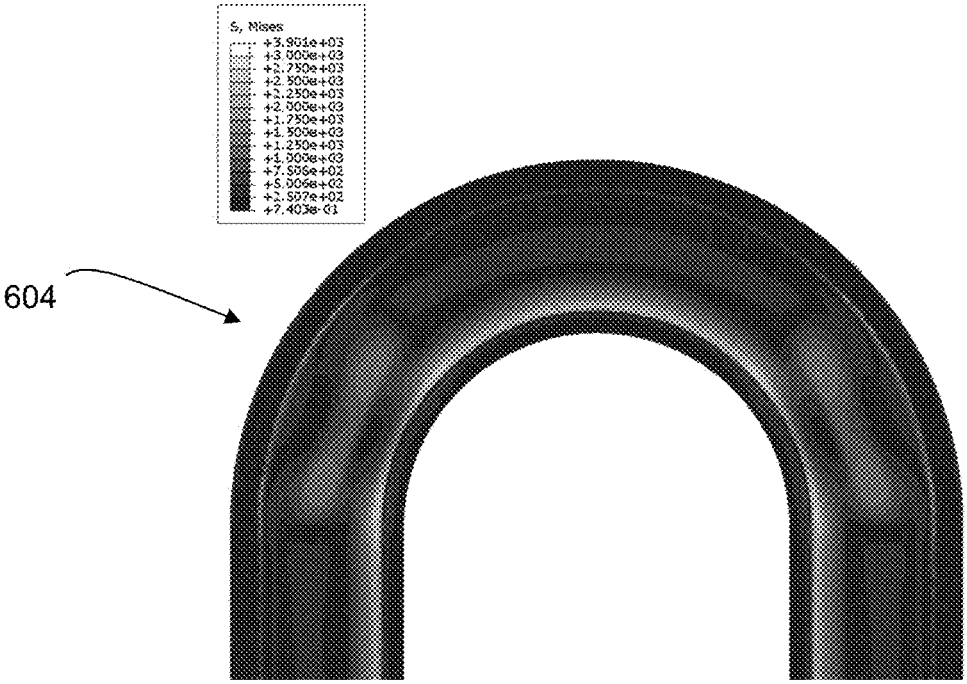
Figure 8A:
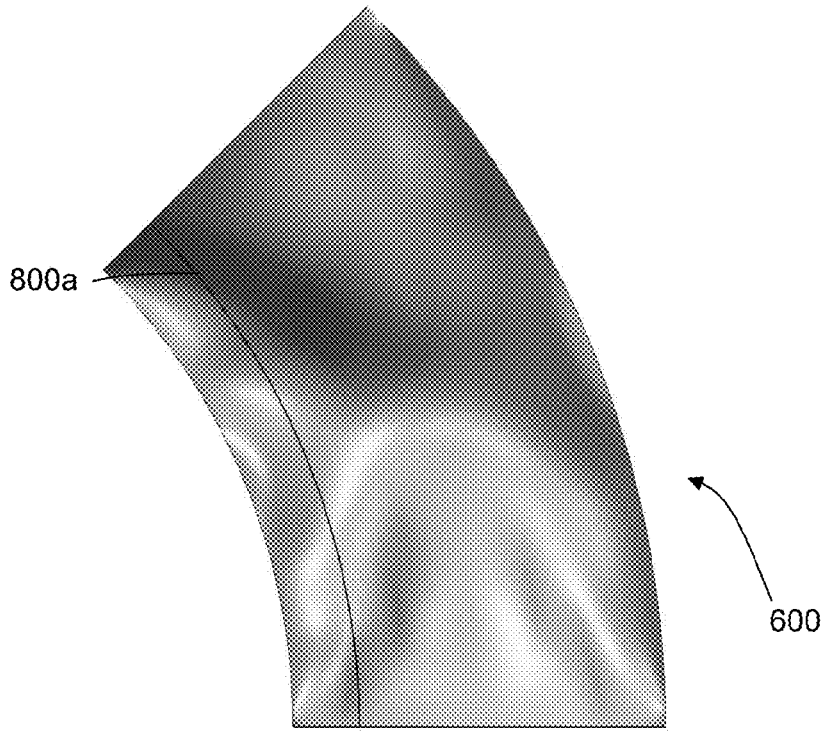
Figure 8A Prior Art
FIGS. 8A and 8B illustrate differences in curvature of the surrounds of FIGS. 6A and 6B at a given radius.
Figure 8B:
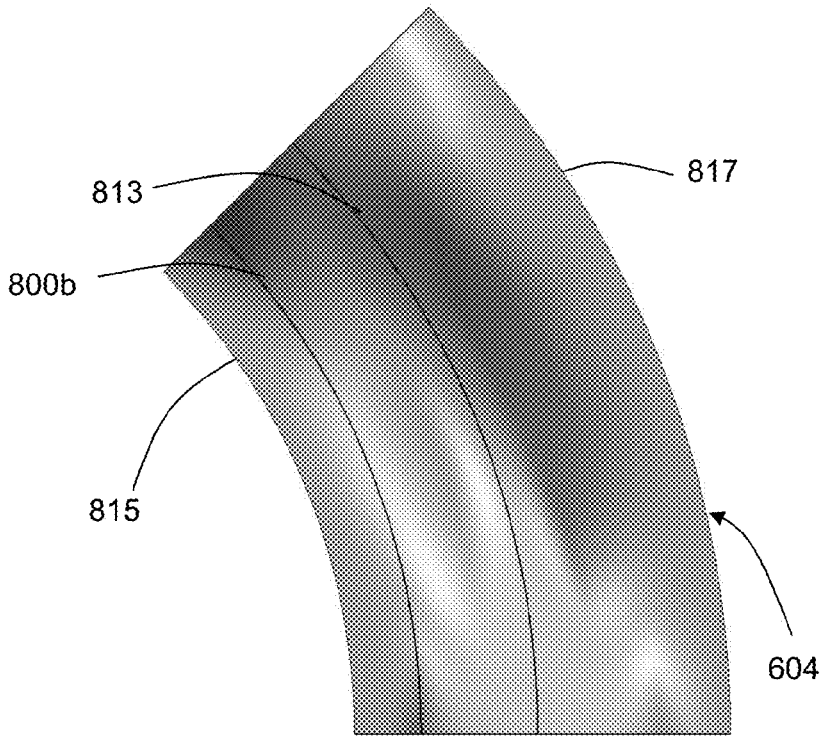
Figure 9A:
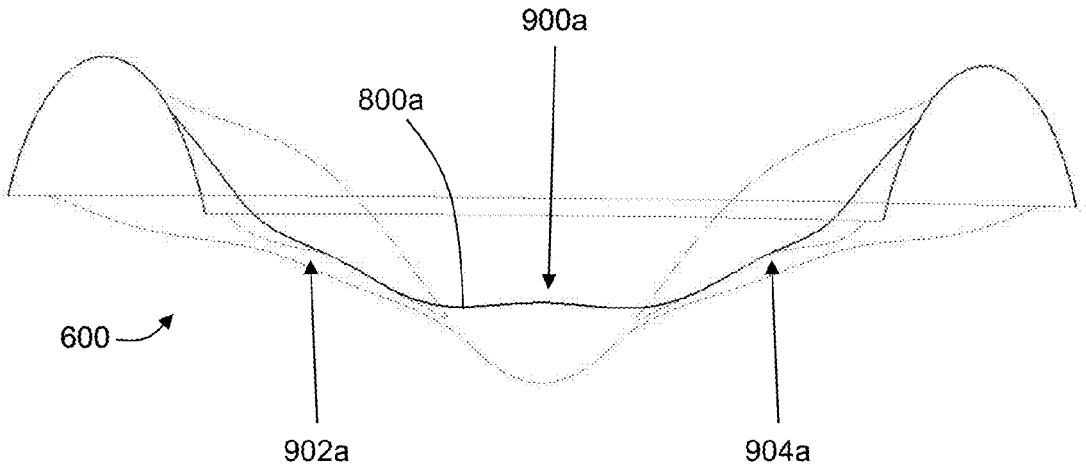
Figure 9A Prior Art
FIGS. 9A and 9B illustrate sectional views of the portions of the surrounds illustrated in FIG. 8A and FIG. 8B respectively at reference 800.
Figure 9B:
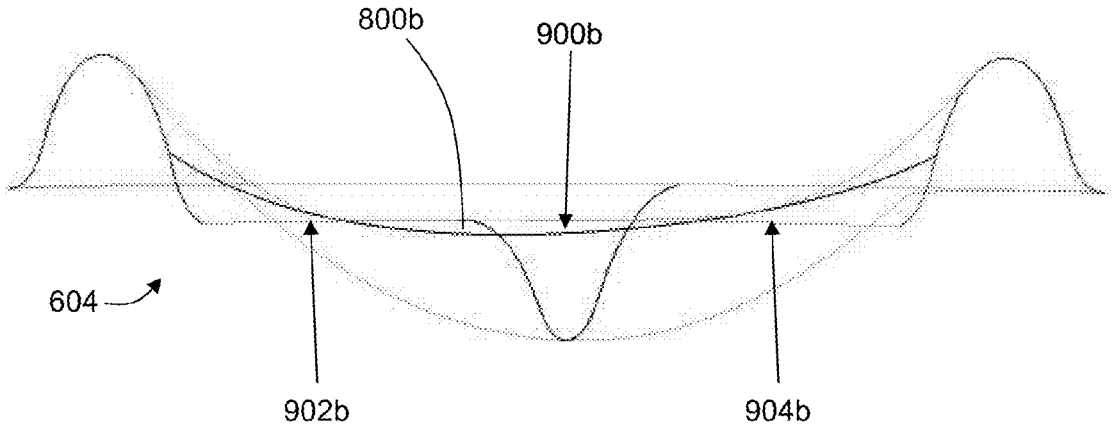

FIGS. 7A and 7B illustrate a model of stress at peak displacement for the surrounds 600, 604 of FIGS. 6A and 6B, respectively. Reduction or elimination of localized radial cross-sectional inflexions may reduce undesirable stress, e.g., at peak displacement. Note that the maximum stress in prior art FIG. 7A is higher than the maximum stress in FIG. 7B. Further, the total area subjected to stress higher than 3000 kPa as indicated by lighter coloration is greater in prior art FIG. 7A than in FIG. 7B.

Referring to FIGS. 8A, 8B, 9A and 9B, circumferential cross-sectional curvature at transitions of concavity may also be enhanced in accordance with some aspects. Differences in circumferential cross-sectional curvature relative to the prior art at transitions of concavity can be seen in corresponding sections 800*a*, 800*b* at corresponding locations 900*a*, 900*b*, 902*a*, 902*b*, and 904*a*, 904*b*. Irregularities in cross-sectional curvature such as localized circumferential cross-sectional inflexions may introduce undesirable stress. The surround 604 may also be characterized by circumferential cross-sections having smooth curvature. Note also that the concavity of surround 604 may remain centered at a predetermined constant radius 813 from the center of the surround. For example, the predetermined radius 813 may be coincident with a radius which defines vertices of the half roll and inverted half roll segments relative to the innermost edge 815 and outermost edge 817 of the surround. Further, the radius 813 may be at a midpoint between the innermost edge 815 and outermost edge 817 of the surround.

Figure 10:
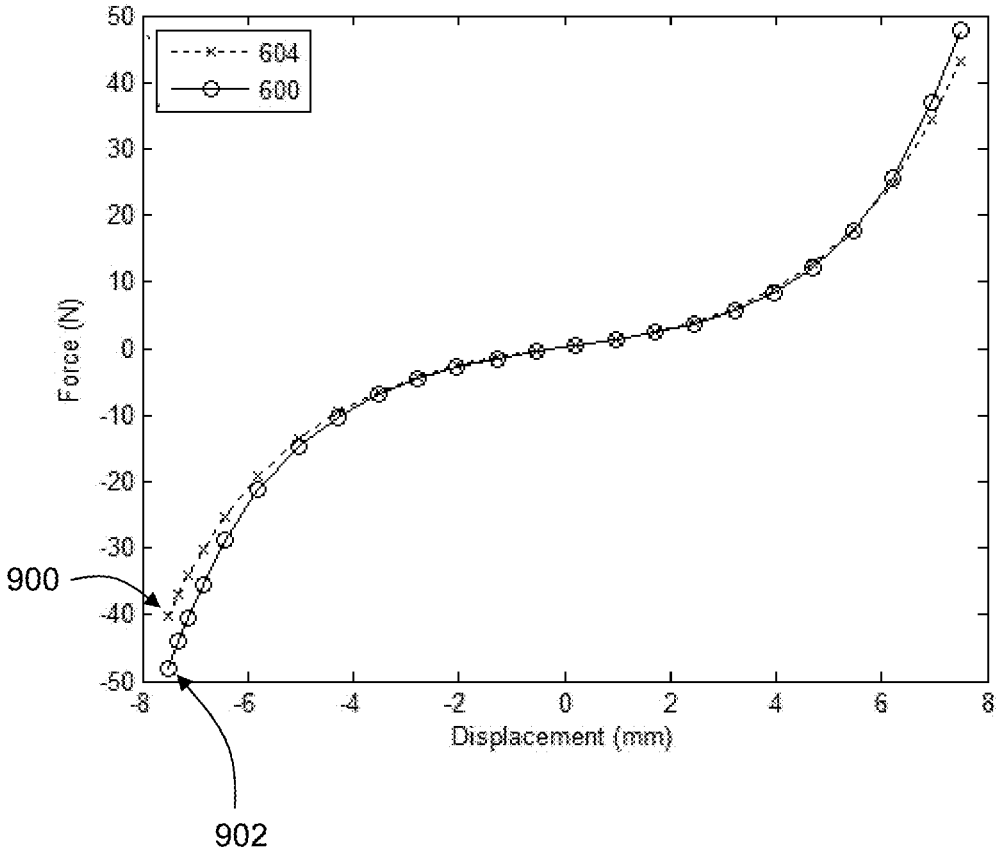
FIG. 10 illustrates a modeled comparison of force versus displacement for the surrounds of FIGS. 6A and 6B.

FIG. 10 illustrates a modeled comparison of force versus displacement for prior art design surround 600 versus surround 604. Note that the greater stresses at peak displacement of the prior art design surround 600 result in the need for more force for a given amount of displacement approaching peak displacement. For example, at position 900 a force of −40 N is required for −7.5 mm of displacement of surround 604, whereas at corresponding position 902 a force of −48 N is required for −7.5 mm of displacement of prior art surround 600. The nonlinearity of the force-displacement curve for surround 604, or stiffening at large excursions, may be adjusted by varying different characteristics. Axial stiffness increases at transitions of concavity. Axial stiffness can be reduced by reducing material thickness, e.g., making the material at concave-convex transitions thinner than elsewhere. Axial stiffness can also be increased by reducing free length and reduced by increasing free length. If desired, the increase in axial stiffening at transitions of concavity can be countered at least in part by reducing surround material thickness proximate to the transitions of concavity, increasing free length proximate to transitions of concavity, or both.

Figure 4:
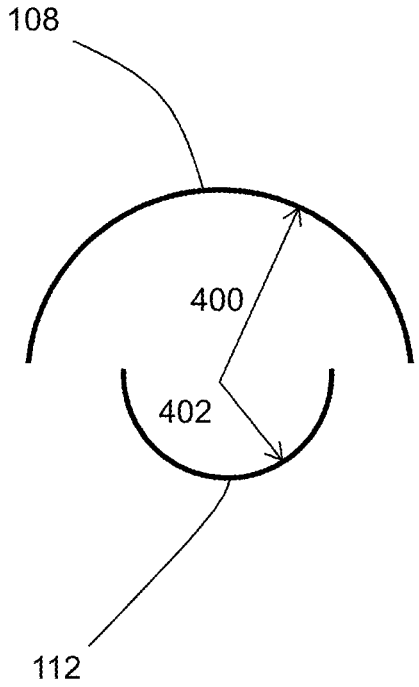
FIG. 4 illustrates different concavity dimensions.
Figure 11:
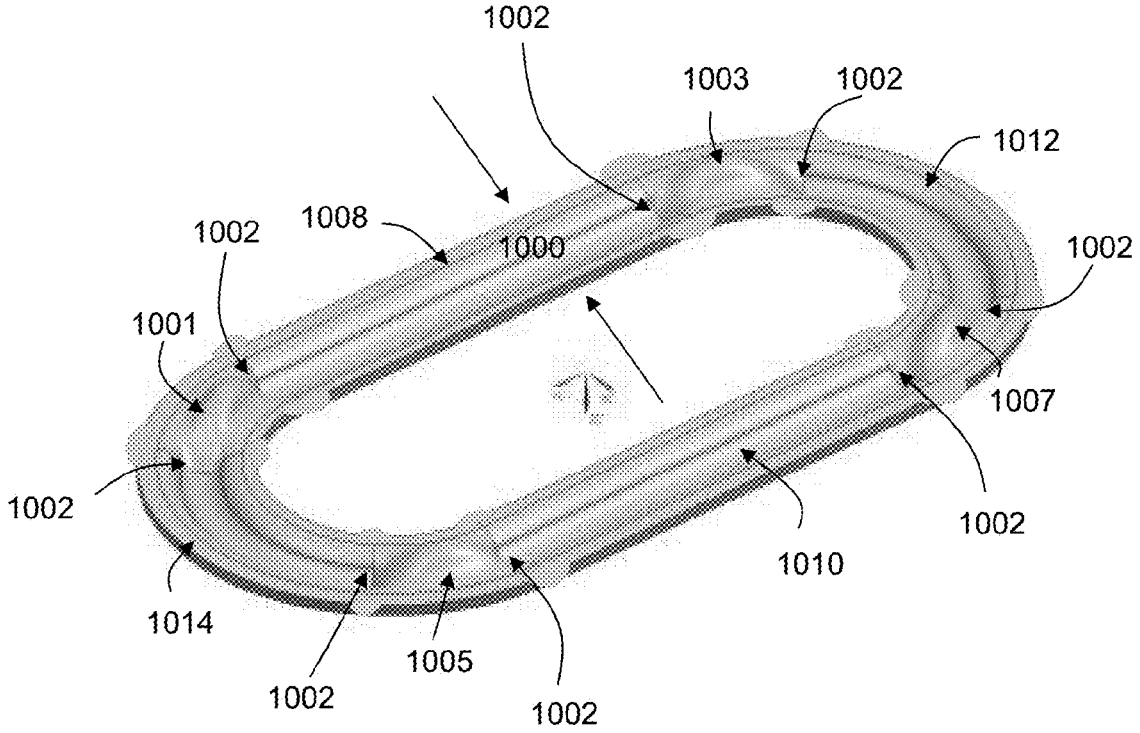
FIG. 11 illustrates a variable width surround feature.

FIG. 11 illustrates variation of free length as a function of variation of the width 1000 of the surround. For example, the width of the surround may vary such that it is relatively greater proximate to transitions 1002 of concavity in comparison with areas on unchanging concavity, such as portions of inverted half roll segments 1008, 1010, 1012, and 1014 where cross-sectional shape is constant. Half roll segments 1001, 1003, 1005, 1007 do not necessarily have portions with constant cross-sectional shape. Localized changes (increases or decreases) in the width of the surround can effectively increase or decrease the free length of the surround in those areas. By providing additional free length via increased surround width proximate to transitions of concavity it is possible to achieve less nonlinearity in the force-displacement curve, as well as lower stress. Further, surround width may be varied in coordination with differences in free length of the half roll and inverted half roll segments. For example, if the radius of curvature of the half roll segments is greater than the radius of curvature of the inverted half roll segments as shown in FIG. 4 then the surround width may be greater proximate to the inverted half roll segments. As a result, variations in free length may be reduced, eliminated, or otherwise controlled to achieve a desired result. For example, since the free length at a transition of concavity may be reduced by the inflexion, increasing the width of the surround in a transition section relative to sections where no transition is present reduces variations in free length around the perimeter, which reduces non-linearity and improves performance.

While the invention is described through the above examples, it will be understood by those of ordinary skill in the art that a wide variety of modifications to and variations of the illustrated aspects are possible without departing from the concepts herein disclosed. Moreover, while the preferred embodiments are described in connection with various illustrative structures, one of ordinary skill in the art will recognize that the system may be embodied using a wide variety of structures. Accordingly, the invention should not be viewed as limited except by the scope and spirit of the appended claims.

What is claimed is:

1. An apparatus comprising:

a diaphragm;

a rigid member; and a resilient surround which couples the diaphragm to the rigid member such that the diaphragm is movable in a reciprocating manner relative to the rigid member, the surround including adjacent segments along a length of the surround of a first type and a second type differentiated by inversion of concavity, a total length of segments of the first type being substantially unequal to a total length of segments of the second type.

2. The apparatus of claim 1 in which the first type of segment is a half roll and the second type of segment is an inverted half roll.

3. The apparatus of claim 2 in which the rigid member is associated with an enclosure, and in which the half roll segment provides additional enclosure volume to accommodate an element within the enclosure.

4. The apparatus of claim 3 in which the inverted half roll segment is located where additional volume within the enclosure is not needed.

5. The apparatus of claim 1 in which the surround is circular and regions of transitional concavity provide increased stiffness in a primary axis of vibration.

6. The apparatus of claim 1 in which the surround is non-circular and is characterized by a greater length in a first dimension than in a second dimension, and wherein regions of transitional concavity separated by a greater distance in the first dimension than in the second dimension provide increased stiffness in a primary axis of vibration.

7. The apparatus of claim 6 in which the surround is a racetrack surround characterized by semicircular ends separated by a length in the first dimension, parallel sides separated by a length in the second dimension, and in which the regions of transitional concavity are located where the parallel sides transition to the semicircular ends.

8. The apparatus of claim 2 wherein the half roll segments are characterized by a first radius of curvature, the inverted half roll segments are characterized by a second radius of curvature, and wherein the first radius of curvature is unequal to the second radius of curvature.

9. The apparatus of claim 2 in which the half roll segments are characterized by a first width between inner and outer edges, the inverted half roll segments are characterized by a second width between inner and outer edges, and the first width is unequal to the second width.

10. The apparatus of claim 1 in which the surround has a non-constant width.

11. The apparatus of claim 10 in which the width is increased proximate to regions of transitional concavity.

12. The apparatus of claim 1 in which transitions between segments of the first type and the second type have smooth curvature.

13. The apparatus of claim 1 in which transitions between segments of the first type and the second type are free of localized radial cross-sectional inflexions.

14. The apparatus of claim 1 in which transitions between segments of the first type and the second type are free of localized circumferential cross-sectional inflexions.

15. The apparatus of claim 1 further including regions of transitional concavity characterized by a different material thickness than segments of the first and second types.

16. The apparatus of claim 1 in which concavity of the surround is centered at a constant radius.

17. The apparatus of claim 16 in which the radius is a midpoint between inner and outer edges of the surround.

18. The apparatus of claim 2 in which a total extent of half roll segments is less than 50% of a total extent of the surround.

19. The apparatus of claim 2 in which a total extent of half roll segments is less than 30% of a total extent of the surround.

20. The apparatus of claim 2 in which a total extent of half roll segments is less than 20% of a total extent of the surround.

21. The apparatus of claim 2 in which a total extent of half roll segments is less than 10% of a total extent of the surround.

22. An apparatus comprising: a resilient element which couples a first rigid element to a second rigid element such that the first rigid element is movable in a reciprocating manner relative to the second rigid element, the resilient element including adjacent segments along a length of the resilient element of a first type and a second type differentiated by inversion of concavity, a total length of segments of the first type being substantially unequal to a total length of segments of the second type.

23. An apparatus comprising:

a resilient element which couples a first rigid element to a second rigid element such that the first rigid element is movable in a reciprocating manner relative to the second rigid element, the resilient element including multiple half roll segments and multiple inverted half roll segments along a length of the resilient element, a total length of the inverted half roll segments being substantially greater than a total length of the half roll segments; and an enclosure connected to the second rigid element, the enclosure characterized by high back pressure at peak excursion of the first rigid element toward the enclosure in a primary axis of vibration.

24. The apparatus of claim 23 in which at least one of the half roll segments provides increased clearance relative to an object proximate to the resilient element within the enclosure.

25. The apparatus of claim 23 in which at least one of the half roll segments provides increased local axial stiffness which improves rocking behavior.

26. The apparatus of claim 23 in which a total extent of the half roll segments is selected to minimize variation of radiating surface area of the resilient element as a function of displacement in the primary axis of vibration.

* * * * *